US007004850B1

(12) United States Patent
Hong

(10) Patent No.: US 7,004,850 B1
(45) Date of Patent: Feb. 28, 2006

(54) TRAINING GOLF CLUB

(76) Inventor: Hsian-Chou Hong, 9F-2, No. 111, Chin Shan St., Yang Mei Jen, Tao Yuan Hsien (TW)

( * ) Notice: Subject to any disclaimer, the term of this patent is extended or adjusted under 35 U.S.C. 154(b) by 0 days.

(21) Appl. No.: 10/971,153

(22) Filed: Oct. 25, 2004

(51) Int. Cl.
*A63B 69/36* (2006.01)

(52) U.S. Cl. ..... 473/256; 473/219; 473/226; 473/228

(58) Field of Classification Search ..... 473/219, 473/226, 228, 229, 256, 257, 266, 268, 269
See application file for complete search history.

(56) References Cited

U.S. PATENT DOCUMENTS 3,458,203 A * 7/1969 Mangis ..... 473/256
3,951,415 A * 4/1976 Stuart ..... 473/238
4,576,378 A * 3/1986 Backus ..... 473/228
4,655,457 A * 4/1987 Thompson ..... 473/239
5,174,577 A * 12/1992 Warde et al. ..... 473/234
5,184,825 A * 2/1993 Ruth ..... 473/228
5,310,188 A * 5/1994 Hernberg ..... 473/206
5,335,918 A * 8/1994 Rupnik et al. ..... 473/228
5,415,406 A * 5/1995 Reichenbach et al. ..... 473/228
5,421,579 A 6/1995 Uebele, Jr.
5,984,795 A * 11/1999 Stafford ..... 473/206
6,322,456 B1 11/2001 Benggon
6,881,156 B1 * 4/2005 Phillips ..... 473/228

* cited by examiner

*Primary Examiner*—Nini F. Legesse
(74) *Attorney, Agent, or Firm*—Rosenberg, Klein & Lee

(57) ABSTRACT

A training golf club helps a golfer become aware of the direction and angle of their swing and adjust their stance, the angle at which they are holding their club and the direction of their swing or putter when practicing. The golf club has a club-shaft, a club-grip, and a club-head. An improvement includes an assistant plate being fixed onto the club-shaft. The assistant plate is parallel to the ball striking face of the club-head. The assistant plate has a horizontal bottom edge, and the horizontal bottom edge and a bottom edge of the club-head is preferably located along a same plane.

16 Claims, 10 Drawing Sheets

TRAINING GOLF CLUB

BACKGROUND OF THE INVENTION

1. Field of the Invention

The present invention relates to a training golf club, and more particularly, to a training golf club for practicing golf, and as a tool for correcting a golfer's swing.

2. Description of Related Art

Golf has gradually become a popular social activity in modern society. Yet a beginner has to practice very hard to strike a golf ball accurately. A regular and correct swing is an important factor for playing golf well.

A good golf swing not only controls the ball's direction, but also makes the ball go further. To control the ball's direction, the golfer must swing the club-head with a perfect motion. As long as the ball is positioned at the lowest point of the full-swing motion, the ball will fly towards the target. To hit the ball further, the golfer needs a perfect release. If a golfer concentrates the strength of his whole body on the ball, and strikes the ball well, they can accurately hit the ball a long way.

An average golfer often thinks that it is too difficult to learn the perfect golf swing. Because the swing path cannot be seen, it is difficult for a golfer to position the club-head along the correct swing-path all the time. As a result, the golfer tries to force the club-head, which leads to weaker shots that may curve off to one side or the other. Some golfers spend a lot of time hitting thousands of golf balls practicing their swing, yet they still cannot achieve a desirable swing.

In order to keep the club-head along the correct path, U.S. Pat. Nos. 5,421,579 and 6,322,456 B1 disclose a fixed path guiding apparatus for golfers. A golf club is slidably engaged with the path guiding apparatus, and the swing of the golfer is guided along a particular path with the assistance of the apparatus. However, the above path-guiding apparatus can only keep the golf club on a fixed path. It is unable to keep the face of the club-head on the correct angle. In addition, the path guiding apparatus is too large and heavy to be portable, so it cannot be used in different places.

The three key stages that lead up to a desirable swing are "setup", "swing plane" and "release". A beginner golfer, however, has difficulty working all the three key points together when they make the fast movements involved in swinging a golf club, because they cannot see the path of their swing.

Even when a coach teaches a golfer, the most important thing for the golfer is to practice continuously over and over again. However, all of the golf clubs invented so far lack a structure for helping a golfer practice by themselves and don't make up for the absence of a coach. After a coach teaches a golfer, it is not easy for a beginner to know if his swing is correct when they practice by themselves. As a result, beginners cannot correct themselves and continue to practice using an incorrect setup. Even when recording themselves on video, beginners are usually unable to correct their own errors.

Therefore, a golf club that can help a golfer to improve their "setup", "swing plane" and "release" when practicing will meet the demands of the many golfers worldwide who wish to improve their game.

SUMMARY OF INVENTION

The primary objective of the invention is therefore to specify a training golf club that is able to help a golfer become conscious of the way in which they are holding and swinging a golf club or a putter. Once they become conscious of any errors, they will be able to adjust their stance, grip, angles or swing by themselves. Thus, the present invention will help a golfer practice effectively and it provides a valuable tool for any golfer, regardless of experience.

Another objective of the invention is therefore to specify a training golf club that helps a golfer practice their "setup", "swing plane" and "release movement" correctly and immediately when practicing.

According to the invention, these objectives are achieved via a training golf club comprising a club-shaft, a club-grip connecting on to a top end of the club-shaft, and a club-head connecting onto a bottom end of the club-shaft. An additional improvement comprises an assistant plate being fixed onto the club-shaft. The assistant plate is perpendicular to the direction in which the ball is to be struck. The assistant plate has a horizontal bottom edge, and the horizontal bottom edge and a bottom edge of the club-head are preferably located along the same plane.

To provide a further understanding of the invention, the following detailed description illustrates the embodiments and examples of the invention. Examples of the more important features of the invention have thus been summarized rather broadly in order that the detailed description thereof that follows may be better understood, and in order that the contributions to the art may be appreciated. There are, of course, additional features of the invention which will be described hereinafter and which will form the subject of the claims appended hereto.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE EMBODIMENTS

Figure 1:
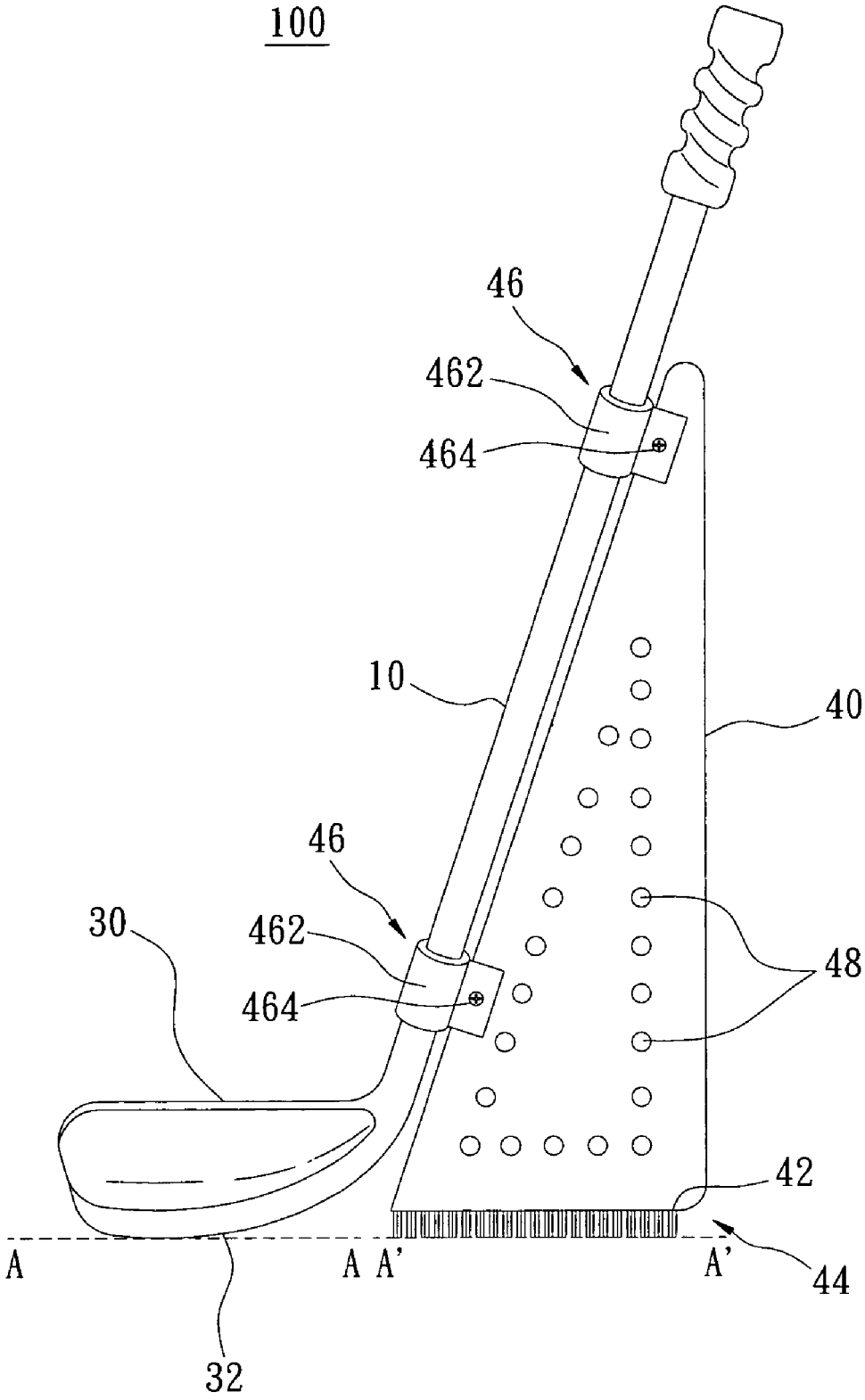
FIG. 1 is a front view of a training golf club of the present invention.

FIG. 1 is a front view of a training golf club of the present invention. The training golf club 1 of the present invention comprises a club-shaft 10, a club-grip 20 connecting onto a top end of the club-shaft 10, and a club-head 30 connecting onto a bottom end of the club-shaft 10. The club-grip 20 has a concave and convex holding shape to ensure the club is held correctly. The club-head 30 further has a ball-striking face 31.

An improvement upon the present invention comprises an assistant plate 40 being fixed onto the club-shaft 10. The assistant plate 40 is perpendicular to the direction in which the training golf club 1 should be swung, or parallel to the ball striking face 31 of the club-head 30. The assistant plate 40 has a horizontal bottom edge 42, and the horizontal bottom edge 42 and a bottom edge 32 of the club-head 30 are preferably located along the same plane. In this embodiment, a horizontal line A—A is assumed at the bottom edge 32 of the club-head 30. The assistant plate 40 has a plurality of soft buffer strips 44 connected along the bottom edge 42 of the assistant plate 40 to form a horizontal line A'—A'. The horizontal line A—A and the horizontal line A'—A' are located along the same plane.

The weight of the material of the assistant plate 40 of the present invention should be light. For example, the assistant plate 40 can be made of acrylic or a wooden board.

Figure 2:
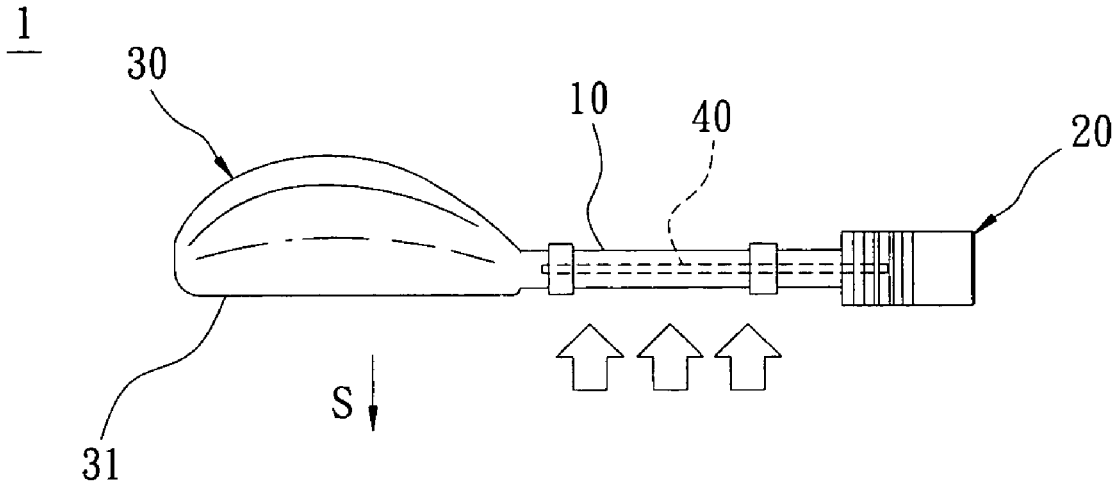
FIG. 2 is a top planar view of a training golf club of the present invention taken from a top view of a golfer.

FIG. 2 is a top planar view of a training golf club of the present invention taken from the top view of a golfer. A correct swing is one in which the ball striking face 31 of the club-head 30 strikes a golf ball vertically. If the ball striking face 31 strikes the golf ball obliquely, the ball will fly in an incorrect path, namely a slice or a hook. The present invention applies the above principle. When swinging, the golfer should not be able to see the assistant plate 40 if their body position and swing are correct. The assistant plate 40 should always be parallel to the ball striking face 31 of the club-head 30, or in other words, perpendicular to the direction in which the ball is to be struck. The assistant plate 40 is blocked by the club-shaft 40. Therefore, the golfer can judge if their body position, grip, and manner of holding and swinging the golf club are correct by looking at the golf club and the assistant plate 40.

As the ball striking face 31 of the club-head 30 is perpendicular to the swing plane, the assistant plate 40 will not protrude from the club-shaft 10 when the golfer looks at the ball whilst in a correct stance. If the golfer can see the assistant plate 40, it means that they are either holding the golf club incorrectly or standing incorrectly, so an adjustment needs to be made. By using the training golf club 1 of the present invention, the golfer can adjust their own body position and angle of striking the ball when practicing.

Figure 3:
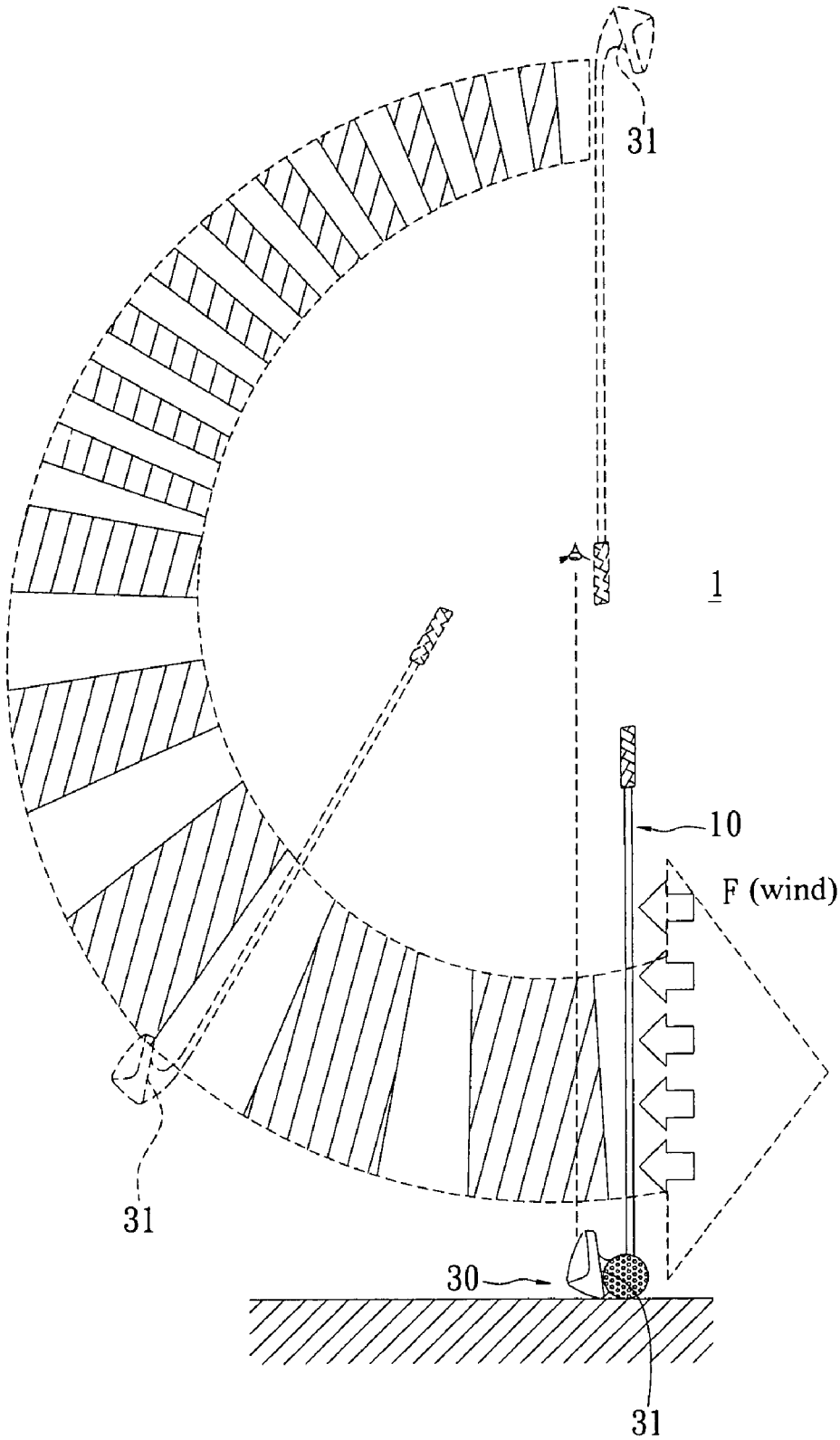
FIG. 3 shows a front view of various positions of a training golf club of the present invention when the golf club is swung.

FIG. 3 shows a front view of various positions of a training golf club of the present invention when the golf club is swung. The assistant plate 40 of the present invention further produces a certain wind resistance. When the angle of the assistant plate 40 becomes oblique, the wind resistance is changed. After practicing many times, even if the golfer does not look at the assistant plate 40, they can experience the change in wind resistance and immediately adjust the way in which they are holding or swinging the golf club or putter. By looking down from the top of the golf club or experiencing the wind resistance produced by the assistant plate 40, the golfer can sense what they are doing incorrectly and adjust themselves their action accordingly.

In this embodiment, the assistant plate 40 has a shape similar to that of a right triangle. In principle however, any shape can be used as long as the assistant plate 40 is parallel to the ball striking face 31 of the club-head 30. For example, the assistant plate 40 can also be shaped like a sector. In addition, it is helpful if the bottom edge 42 of the assistant plate 40 and the bottom edge 32 of the club-head 30 are preferably located along the same plane.

In this embodiment, the assistant plate 40 has a plurality of soft buffer strips 44 connected onto the bottom edge 42 of the assistant plate 40. The soft buffer strips 44 are conducive to moving the assistant plate 40 along the grass surface smoothly. The soft buffer strips 44 may be made of soft hair, cloth or a plastic material.

To reduce the weight of the assistant plate 40 and to avoid an excessively strong wind resistance, the assistant plate 40 may have a plurality of small through holes 48. The through holes 48 of the assistant plate 40 may be veins or patterns that can make the design of the plate more attractive, or may be hollow signs for personal or commercial use.

In this embodiment, the assistant plane 40 is fixed onto the club-shaft 10 by at least two fastening devices 46. Each of the fastening devices 46 has a fastening ring 462 and a fastening screw 464. The fastening ring 462 surrounds the club-shaft 10 and a part of the assistant plate 40. The fastening screw 464 secures the fastening ring 462 on the assistant plate 40.

The above illustration is a preferable embodiment of the present invention. The scope of the present invention includes an assistant plate added to a golf club. For example, the training golf club may also be made of wood, and the assistant plate clips onto the wood club-shaft, allowing the above training methods to be used.

The three key points of a desirable golf swing are "setup", "the swing plane" and "release". However, a beginner golfer has difficulty working on all three key points together when making the fast movements of swinging a golf club, because they are unable to see their own swing path. The assistant plate 40 solves this problem.

Figure 4:
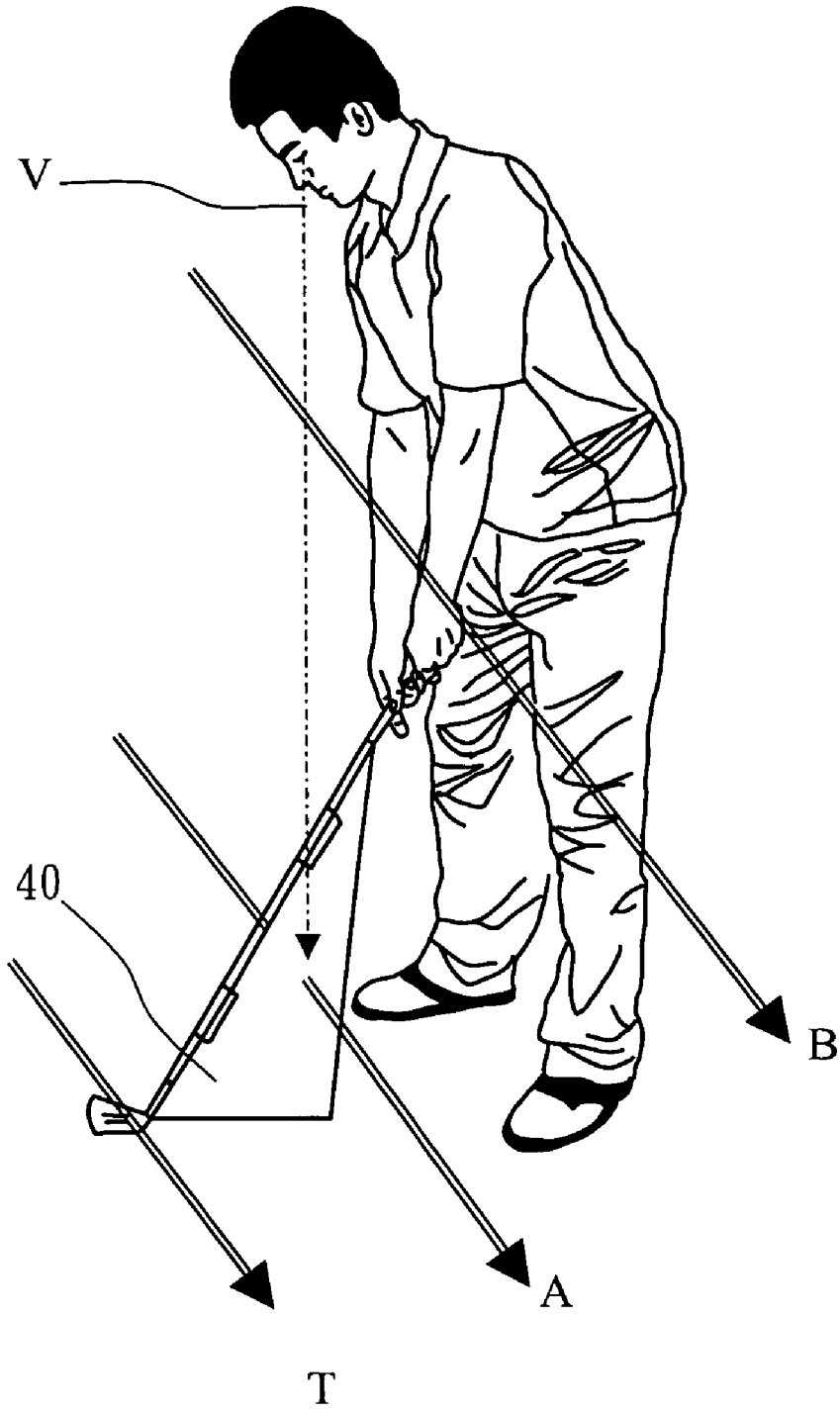
FIG. 4 shows a schematic view of a correct setup when a golfer uses a training golf club of the present invention.
Figure 5:
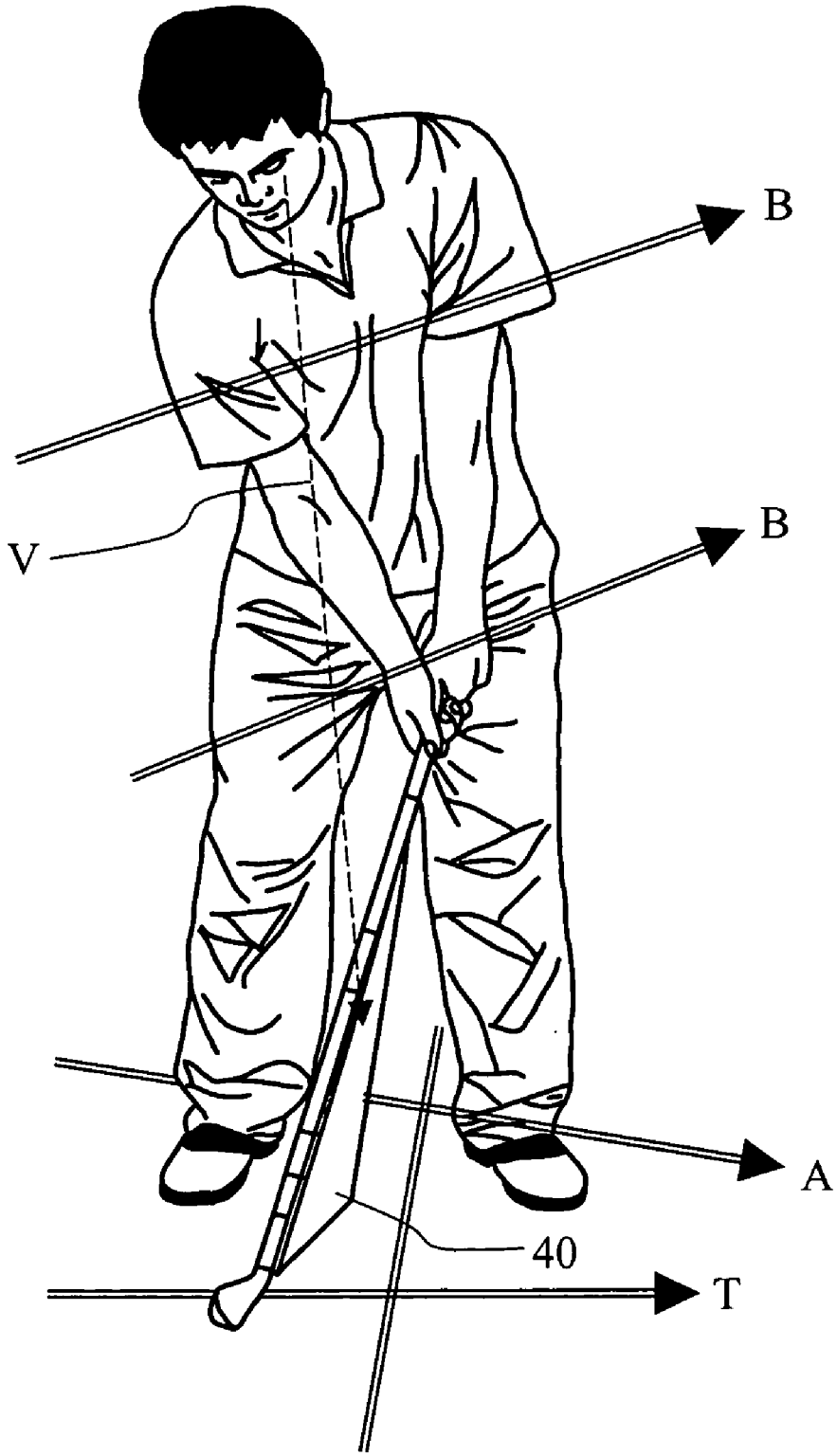
FIG. 5 shows a schematic view of an incorrect setup when a golfer uses a training golf club of the present invention.

During "setup", many golfers usually make errors aligning themselves with the ball, that is to say the club-face is not pointed correctly at the target or the golfer's body line is not parallel to the target line. If there are errors in the setup and the position of the club-face at the beginning, then how can the golfer have a correct swing? If the golfer makes this mistake in setup, they will have to make compensations in their swing to get the ball to the target. The incorrect setup causes practice to be ineffective, if not harmful, to the golfer's game. The assistant plate 40 helps the golfer establish a good setup. FIG. 4 shows a schematic view of a correct setup when a golfer uses a training golf club of the present invention. In the correct "setup", the golfer's line of sight V cannot see either the front or back face of the assistant plate 40. The assistant plate 40 helps the golfer to judge easily so that their setup is correct. If their stance is incorrect (including the aiming movement B of the golfer, if the golfer's body line is not parallel to the target line T, or if the ball is in a poor position), the golfer will be able to see the face of the assistant plate 40 slightly. In this way, the golfer will realize that their setup is wrong and can then make the proper adjustments. FIG. 5 shows a schematic view of an incorrect setup when a golfer uses the training golf club of the present invention. Because the golfer's aiming movement B is incorrect, or the bodyline of the golfer is not parallel to the target line T, or due to poor ball position, the golfer's line of sight V will allow them to see the face of the assistant plate 40.

Figure 6:
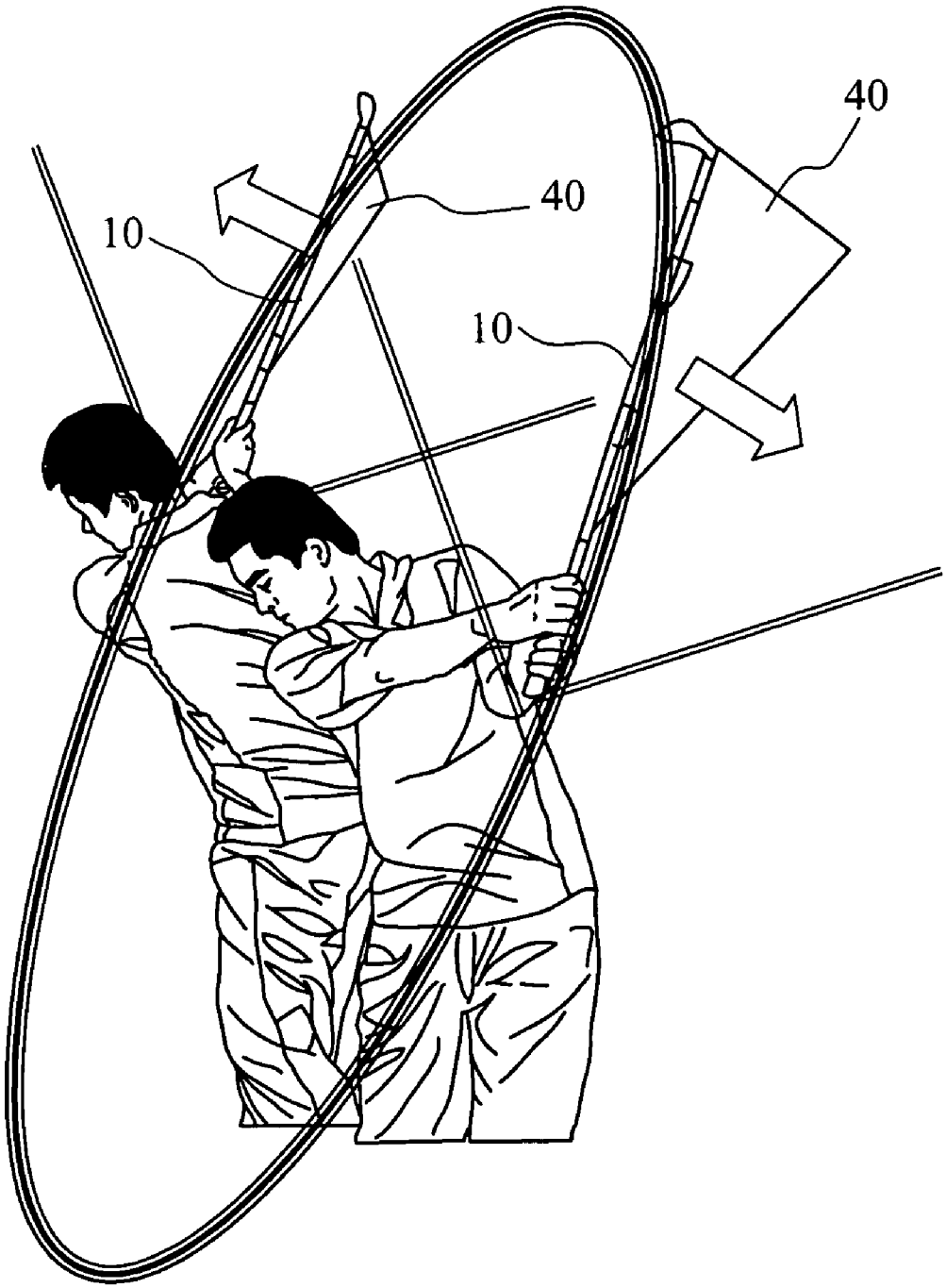
FIG. 6 shows a schematic view of a correct swing plane when a golfer uses a training golf club of the present invention.
Figure 7:
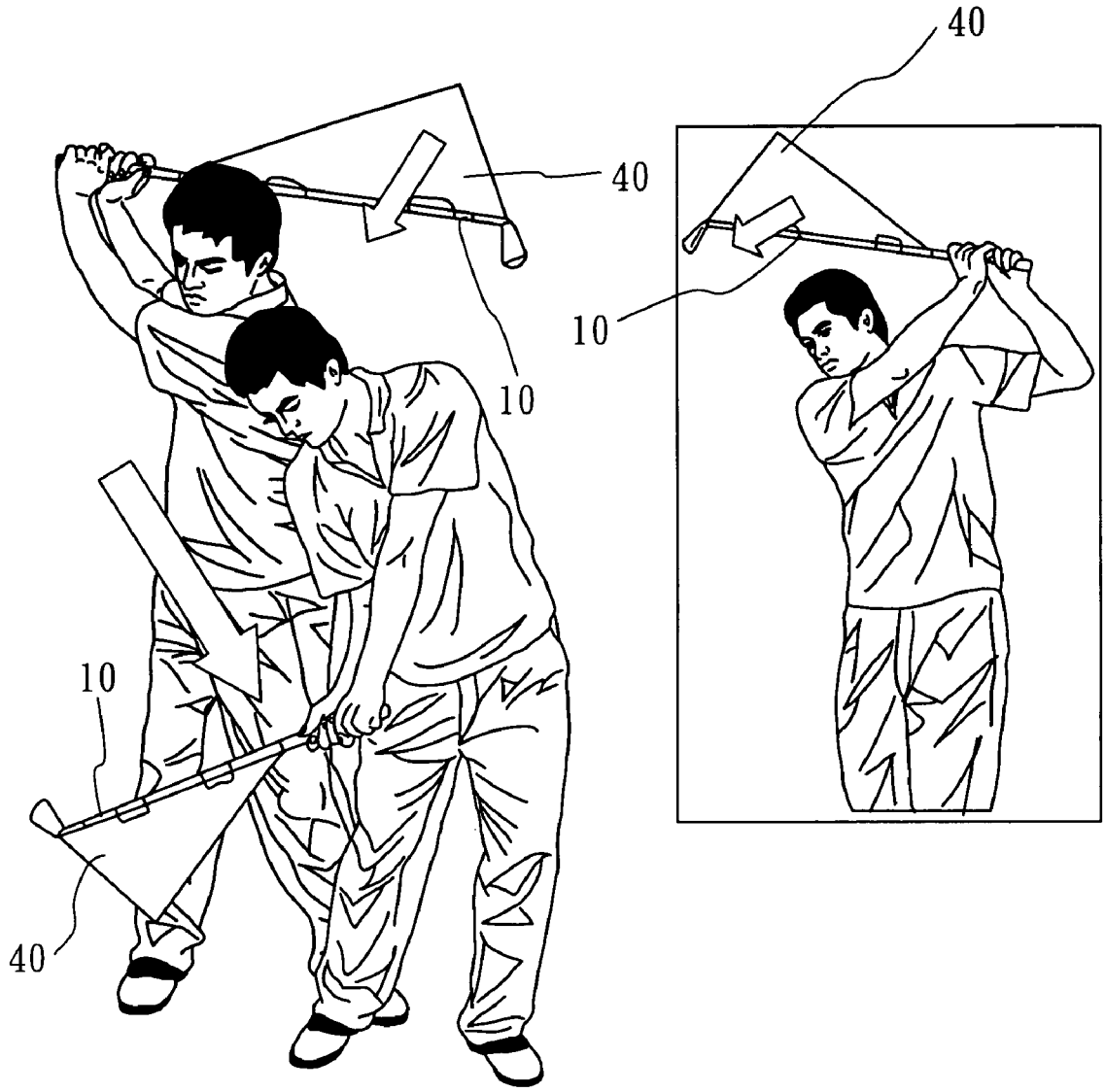
FIG. 7 shows a schematic view of an incorrect swing plane when a golfer uses a training golf club of the present invention.

When swinging the club, the golfer cannot see their swing path, so the golfer has a very difficult time controlling the club due to the fast movements of swinging the club. The golfer is taught to pay attention to the club-shaft to make sure that the club-shaft is at an angle of about 45 degrees when the club is halfway between their back-swing and their through-swing. The plane of the through-swing should correctly mirror the plane of the back-swing as much as possible. This ensures the club-head stays on the correct path. However, it is difficult for the average golfer to achieve this. The assistant plate 40 helps the golfer to overcome this problem. FIG. 6 shows a schematic view of a correct swing plane when a golfer uses a training golf club of the present invention. The correct swing plane and the correct angle of the club-shaft 10 will make sure the assistant plate 40 faces the desired direction when between the halfway point of their back-swing and the halfway point of their through-swing. The golfer can then easily distinguish if their swing plane and the angle of the club-shaft 10 are correct by using the assistant plate 40. FIG. 7 shows a schematic view of an incorrect swing plane when a golfer uses the training golf club of the present invention. An incorrect swing plane and an incorrect angling of the club-shaft 10 results in an incorrect swing path and result in the face of the assistant plate 40 pointing towards an incorrect direction. If the face of the assistant plate 40 points to the front of the golfer's body when their back-swing is complete, their down-swing will be incorrect as the club will jam behind the body or the ball will hit from the top thereof. Using the assistant plate 40 solves these commonly made mistakes by golfers.

Figure 8:
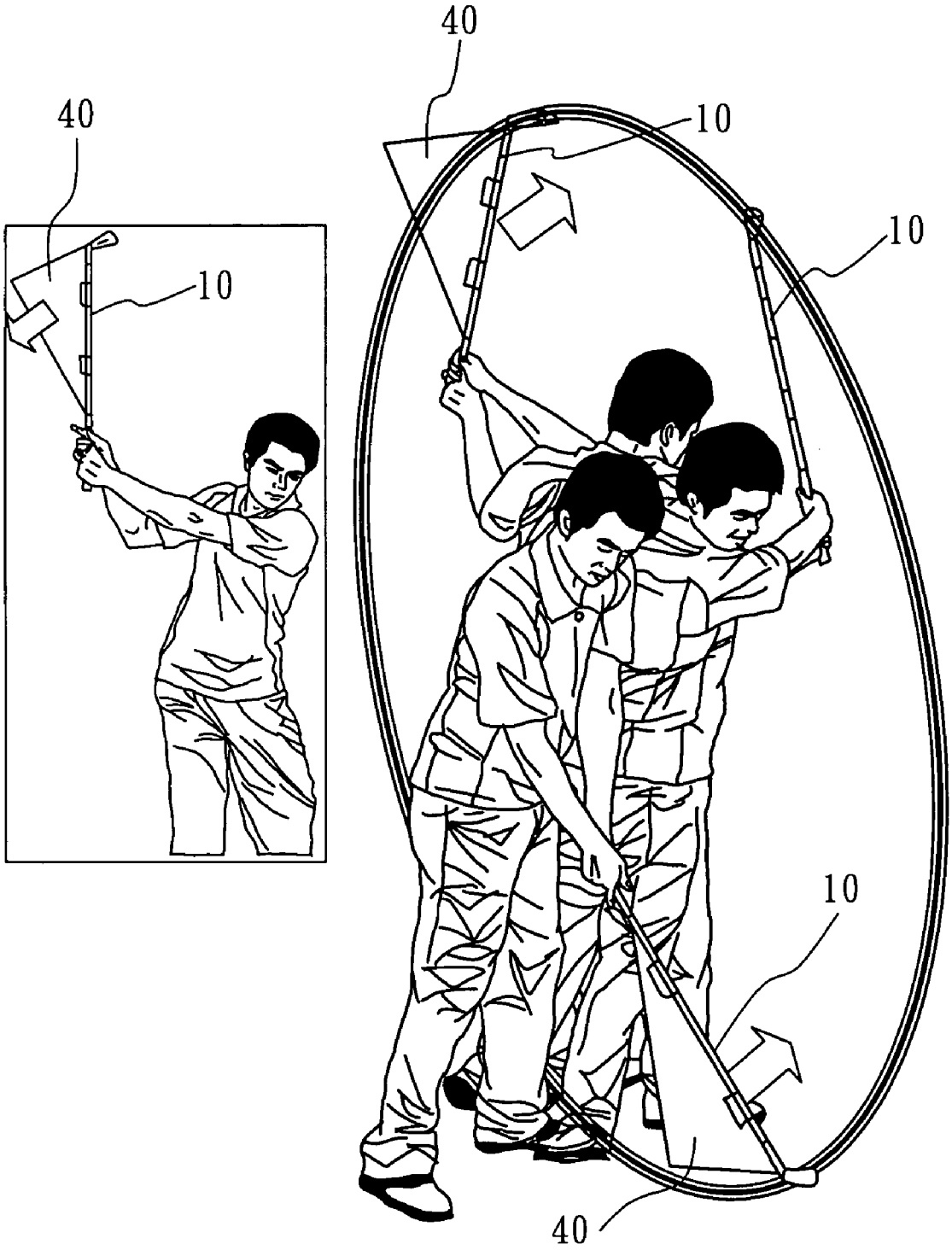
FIG. 8 shows a schematic view of a correct release movement when a golfer uses a training golf club of the present invention.

In the "release" movement, golfers have to make a perfect release movement to swing smoothly from start to finish. A perfect release leads the assistant plate 40 to produce wind resistance. If the golfer makes a wrong release movement, the assistant plate 40 will not produce this wind resistance and the club-head will plummet rapidly when moving from the back-swing to the down-swing. Certainly, before making a perfect "release", the golfer must have the correct "setup" and "swing plane". That is to say, the correct "setup" and "swing plane" are conditions for a perfect "release". It is very difficult for average golfers to do all three things together. The assistant plate 40 of the present invention is an ingenious method for helping a golfer establish a good "setup", "swing plane", and "release" simultaneously. The golfer can learn the movements of a correct swing by themselves through using the assistant plate 40. FIG. 8 shows a schematic view of a correct release movement when a golfer uses a training golf club of the present invention, wherein the arrows represent the correct directions of the face of the assistant plate 40. A perfect release movement will lead the assistant plate 40 to produce wind resistance, such as that of a fan. Certainly, the correct "setup" and "swing plane" have to be work together. As long as the face of the assistant plate 40 points to the correct direction during the back-swing and through-swing stage, the assistant plate 40 will produce wind resistance when the golfer swings. Therefore, the golfer does not have to consider the complicated "swing plane" while swinging the club with the assistant plate 40 and only pays attention to the direction of the face of assistant plate 40. The golfer should never see the front or back face of the assistant plate 40 at any point in the golf swing. If this happens a big, the assistant plate will produce smooth wind resistance and the golfer will know that the club-head is on a desirable path.

Figure 9:
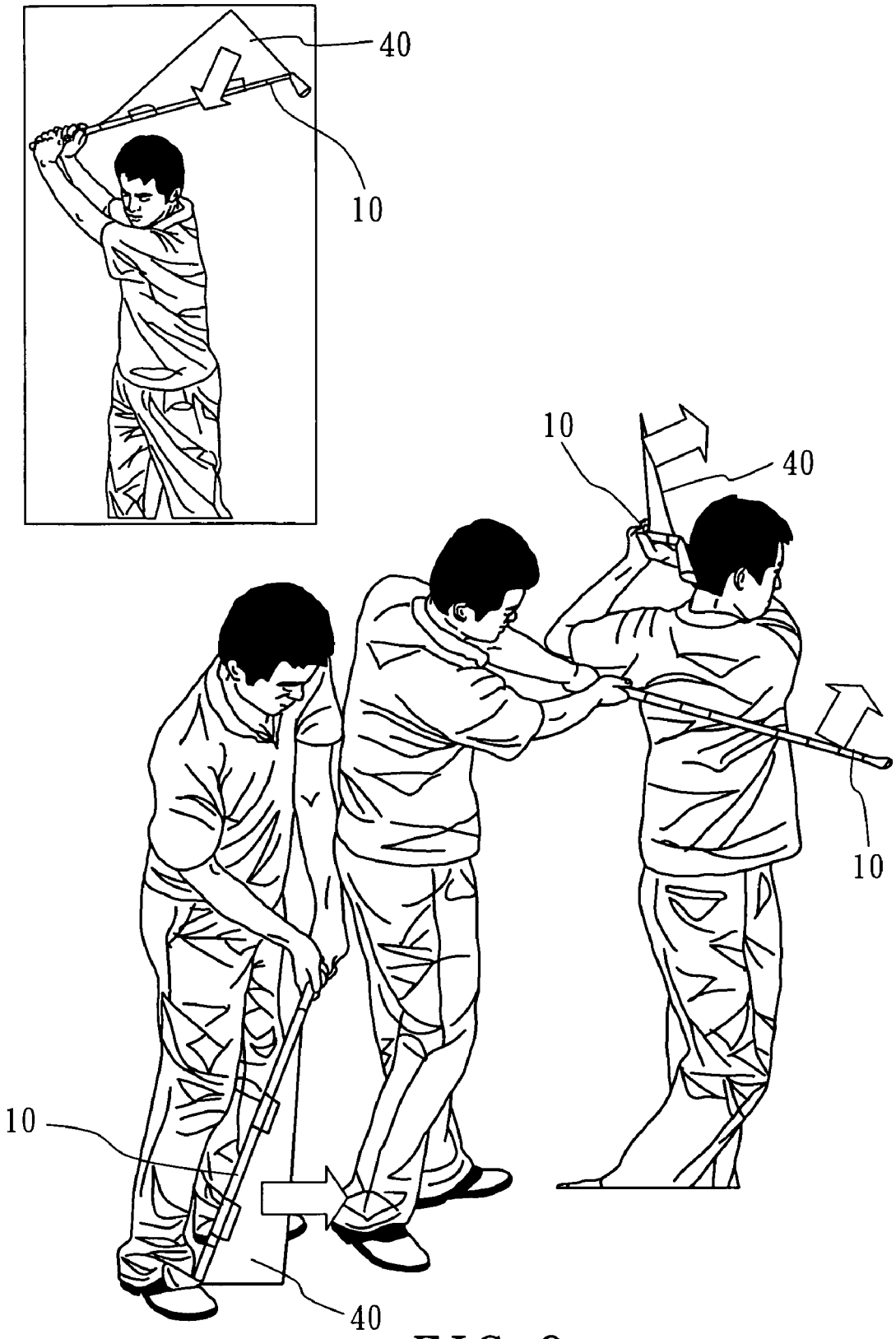
FIG. 9 shows a schematic view of an incorrect release movement when a golfer uses a training golf club of the present invention.

FIG. 9 shows a schematic view of an incorrect release movement when a golfer uses a training golf club of the present invention, wherein the arrows represent the incorrect directions of the face of the assistant plate 40. During an incorrect release movement, a large and smooth wind resistance will not be produced and will cause the face to point towards the wrong direction. In FIG. 9, the release movement will cause the ball to be pulled to the left of the target or the ball will slice away to the right from the golfer. A wrong swing plane produces a wrong release movement. The golfer should not be able to see the front or back face of the assistant plate 40 at the halfway stage of their back swing or through-swing. If they see the front or back face of the assistant plate 40, they know that the club-head is not on the perfect path.

Figure 10:
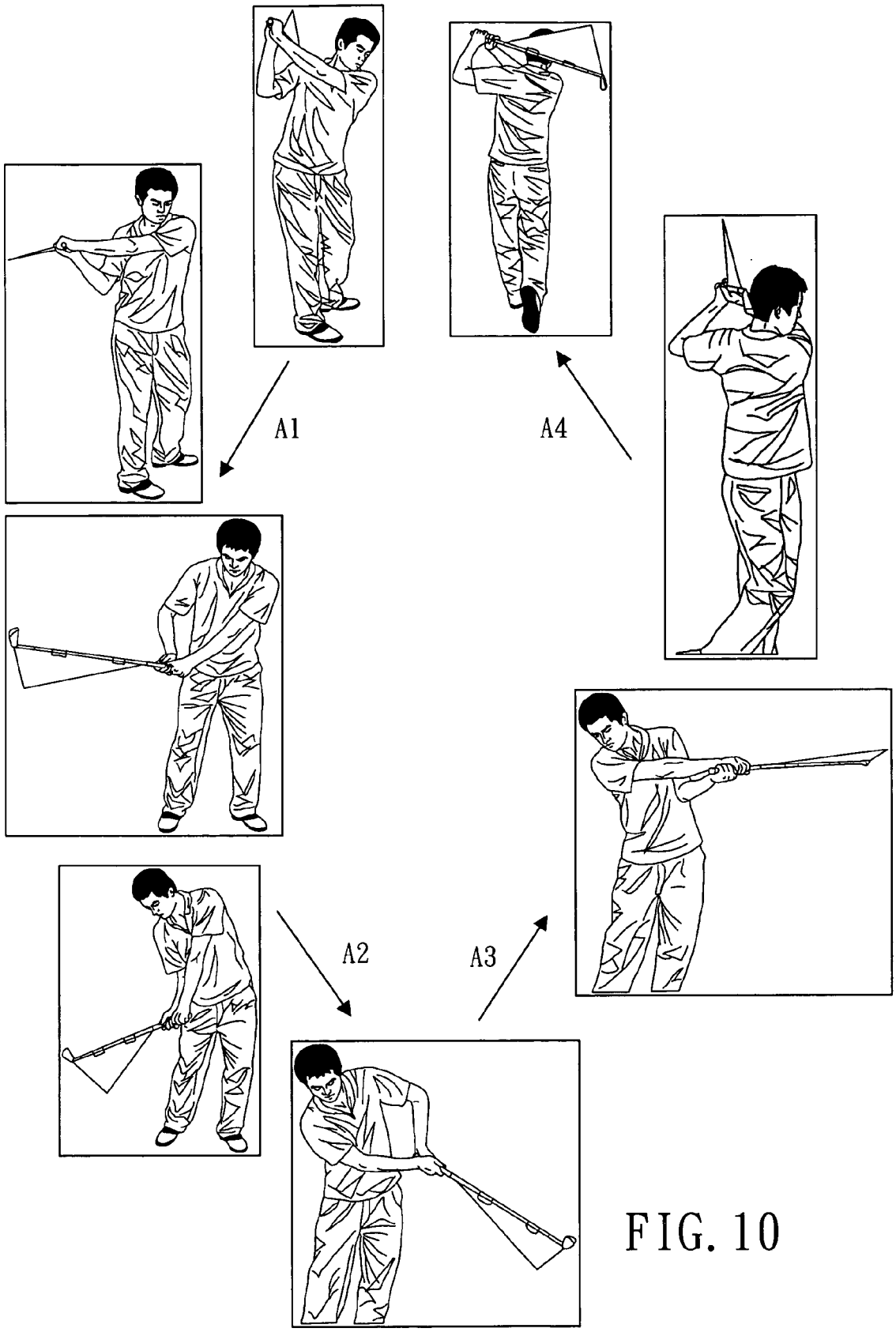
FIG. 10 shows a schematic view of a full incorrect swing when a golfer uses a training golf club of the present invention.

FIG. 10 shows a schematic view of a full incorrect swing when a golfer uses a training golf club of the present invention, wherein A1 represents a wrong back-swing, A2 represents a wrong down-swing, A3 represents a wrong through-swing and A4 represents a wrong finish swing. The assistant plate 40 helps the golfer to correct common wrong movements in their golf swing by themselves thereby ensuring that the golfer does not have to spend much time and money on ineffective practice.

Therefore, the training golf club of the present invention is able to help a golfer become aware of whether or not their manner of holding or swinging a golf club or a putter are correct. It is especially helpful when practicing by oneself how to hold or swing a golf club putter, so that the golfer can adjust their stance, grip and angles thereof by themselves to develop a desirable swing. Hence, the training golf club of the present invention is a valuable tool for a beginner golfer.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A training golf club comprising a club-shaft, a club-grip connecting onto a top end of the club-shaft, and a club-head connecting onto a bottom end of the club-shaft, an improvement comprising:

an assistant plate being fixed onto the club-shaft, the assistant plate being perpendicular to a ball striking direction of the training golf club, the assistant plate having a horizontal bottom edge disposed to extend horizontally from the club-head, and the horizontal bottom edge and a bottom edge of the club-head being substantially located along the same plane.

2. The training golf club as claimed in claim 1, wherein the assistant plate has a shape similar to that of a right triangle.

3. The training golf club as claimed in claim 1, wherein the assistant plate has a plurality of through holes.

4. The training golf club as claimed in claim 3, wherein the through holes are veins or patterns.

5. The training golf club as claimed in claim 1, further comprising a plurality of fastening devices for fixing the assistant plane onto the club-shaft.

6. The training golf club as claimed in claim 5, wherein each of the fastening devices has a fastening ring surrounding the club-shaft and a part of the assistant plate and a fastening screw securing the fastening ring onto the assistant plate.

7. The training golf club as claimed in claim 1, wherein the club-grip has a concave and convex holding shape for a correct holding manner.

8. A training golf club comprising a club-shaft, a club-grip connecting onto a top end of the club-shaft, and a club-head connecting onto a bottom end of the club-shaft, an improvement comprising:

an assistant plate being fixed onto the club-shaft, the assistant plate being perpendicular to a ball striking direction of the training golf club, the assistant plate having a horizontal bottom edge, and the horizontal bottom edge and a bottom edge of the club-head being substantially located along the same plane; and, a plurality of soft buffer strips connecting onto the bottom edge of the assistant plate.

9. The golf club as claimed in claim 8, wherein the soft buffer strips are made of soft hair.

10. The training golf club as claimed in claim 8, wherein the soft buffer strips are made of cloth or plastic material.

11. The training golf club as claimed in claim 8, wherein the assistant plate has a shape similar to that of a right triangle.

12. The training golf club as claimed in claim 8, wherein the assistant plate has a plurality of through holes.

13. The training golf club as claimed in claim 12, wherein the through holes are veins or patterns.

14. The training golf club as claimed in claim 8, further comprising a plurality of fastening devices for fixing the assistant plane onto the club-shaft.

15. The training golf club as claimed in claim 14, wherein each of the fastening devices has a fastening ring surrounding the club-shaft and a part of the assistant plate and a fastening screw securing the fastening ring onto the assistant plate.

16. The training golf club as claimed in claim 8, wherein the club-grip has a concave and convex holding shape for a correct holding manner.

* * * * *